US008011539B1

(12) United States Patent
O'Donnell et al.

(10) Patent No.: US 8,011,539 B1
(45) Date of Patent: Sep. 6, 2011

(54) BULK TANK CRYOGENIC SAFETY SYSTEM

(76) Inventors: Kevin P. O'Donnell, Phoenix, AZ (US); Warren L. Williamson, Mesa, AZ (US); Keith S. Hong, Glendale, AZ (US)

( * ) Notice: Subject to any disclaimer, the term of this patent is extended or adjusted under 35 U.S.C. 154(b) by 838 days.

(21) Appl. No.: 12/070,958

(22) Filed: Feb. 22, 2008

(51) Int. Cl.
*B65D 83/00* (2006.01)

(52) U.S. Cl. ..... 222/394; 222/61

(58) Field of Classification Search ..... 222/394, 222/1, 395–399, 400.5, 400.7, 55, 59, 61; 137/113, 557
See application file for complete search history.

(56) References Cited

U.S. PATENT DOCUMENTS

| | | | | |
|---|---|---|---|---|
| 5,062,443 | A * | 11/1991 | Maric | 137/113 |
| 5,082,143 | A * | 1/1992 | Schramm, Jr. | 222/66 |
| 5,730,323 | A * | 3/1998 | Osborne | 222/55 |
| 5,868,162 | A * | 2/1999 | Dickerson, Jr. | 137/557 |
| 5,871,121 | A * | 2/1999 | Hashimoto et al. | 222/54 |
| 6,251,105 | B1 * | 6/2001 | Mikus et al. | 606/22 |

* cited by examiner

*Primary Examiner* — Lien Ngo
(74) *Attorney, Agent, or Firm* — Wright Law Group, PLLC; Mark F. Wright

(57) ABSTRACT

A bulk tank source of pressurized gas supplies gas to a consumption device, such as a beverage dispenser. A control valve is located between the bulk tank and the consumption device. A pressure monitoring system is connected to monitor the gas pressure between the bulk tank and the control valve. The pressure monitor system closes the valve when pressure drops below a first predetermined threshold, and opens the valve when the monitored pressure exceeds a second predetermined threshold greater than the first predetermined threshold.

20 Claims, 1 Drawing Sheet

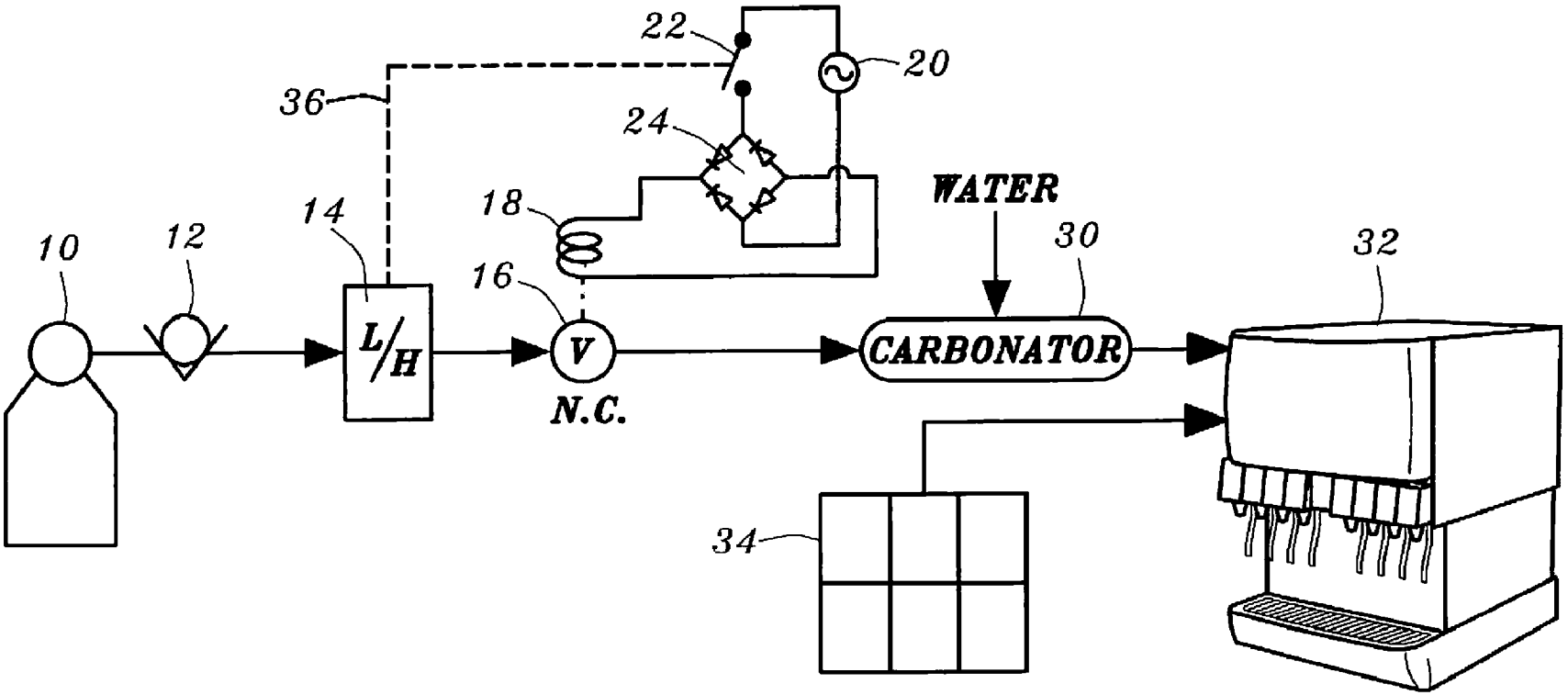
10
12
36
14
L/H
18
16
V
N.C.
22
24
20
WATER
30
CARBONATOR
32
34

BULK TANK CRYOGENIC SAFETY SYSTEM

BACKGROUND

Bulk cryogenic storage of carbon dioxide ($CO_2$) gas is a recent historical development in the beverage industry. Vacuum jacketed storage containers delivering 300 pounds to 750 pounds or more of liquified $CO_2$ gas are widely used. These containers safely deliver gaseous $CO_2$ at pressures above 90 pounds per square inch by converting the liquid $CO_2$ to gas using a natural conversion process through a simple temperature increase effected by ambient temperatures at the location of use.

The gas delivered from such tanks is widely used in conjunction with beverage dispensing machines of the type commonly found in restaurants, convenience stores, theaters, amusement parks and the like. The carbon dioxide ($CO_2$) is mixed with water to produce carbonated water under pressure. The carbonated water then is mixed with a syrup at the dispensing machine to produce the finished carbonated beverage.

$CO_2$ in its gaseous state is a tasteless, colorless, odorless gas which naturally displaces oxygen. If this gas is accumulated in sufficient density in a closed space, such as a storage room, it is hazardous, if not lethal. In facilities which initially produce $CO_2$ gas for ultimate delivery and consumption, multiple safety procedures are employed. Among these are detectors which sense when the $CO_2$ gas level in a particular area exceeds a safe level, to produce a warning alarm.

Bulk storage tanks, however, frequently are located in a confined area adjacent a beverage dispensing machine, frequently, in a small room one wall of which backs onto the location of the machine, or in some other area which is frequented by employees of the establishment using the beverage dispensing machine. $CO_2$ sensors or safety devices typically are not employed where bulk storage tanks are used to supply $CO_2$ to a beverage dispensing machine. In such situations, both employees of the establishment and customers may be exposed to unsafe levels of $CO_2$ gas without their knowledge.

If the syrup box or container used to deliver the flavored syrup to the beverage dispensing machine is empty while the $CO_2$ dispensing line is connected to it, the drop in pressure will allow $CO_2$ gas to pass outwardly into the surrounding area. Also, if a leak should occur in the gas line for delivering the gaseous $CO_2$ to the carbonator or beverage box of a beverage dispensing machine, or if for any reason there is a failure to turn off the delivery of $CO_2$ gas, a drop in pressure, sometimes sudden, takes place at the bulk storage tank.

A sudden drop in pressure of $CO_2$ delivered from the tank causes the liquid $CO_2$ in the bulk container to turn into "dry ice". When this occurs, further delivery of gaseous $CO_2$ from the tank is precluded. This necessitates some type of a service call, since when this occurs, further operation of the beverage dispensing machine ceases. Service calls of this type are unscheduled and are expensive, driving up the operating costs of the entire system.

It is desirable to provide a safety system for bulk cryogenic storage tanks which overcomes the disadvantages of the prior art.

BRIEF DESCRIPTION OF THE DRAWINGS

The sole FIGURE of the drawing is a block diagram of an embodiment of the invention.

DETAILED DESCRIPTION

Reference now should be made to the drawing, which is a block diagram of an embodiment of the safety system of the invention. As shown in the drawing, the system is used in conjunction with a bulk cryogenic storage tank 10 of the type used to store and deliver liquid $CO_2$, converted to a gaseous state, for use in a variety of applications. One such application is shown in FIG. 1 as a beverage dispensing unit 32.

The gas delivery line from the tank 10 is connected through a conventional high pressure regulator 12, which regulates the output gas flow from the tank 10 to a pressure of approximately 90 to 110 pounds per square inch. The pressure regulator and the amount of pressure of gas delivered from the tank is conventional, in a range typically used by beverage dispensing units, such as the unit 32. After passing through the regulator 12, the gas line is connected to the input of a safety tank pressure monitor system or unit 14, which monitors the pressure of gas in the line and particularly includes controls for sensing low pressure, such as caused by a leakage in the gas line or an open $CO_2$ connection downstream from the unit 14.

The monitor unit 14 includes adjustable electronic circuitry, or other suitable means, for continuously monitoring the pressure in the line as it flows through the system 14. The operation of the system 14, in conjunction with other portions of the system, is described in greater detail subsequently.

The gas line, after passing through the safety tank pressure monitor system 14, is connected through a normally closed control valve 16, from which it then is connected to a conventional carbonator 30, also supplied with water, as shown in the drawing. The output of the carbonator 30 is supplied to the beverage dispensing machine 32, along with syrup for selected beverages from a beverage box cluster or a single beverage box 34, indicated in the drawing. The manner in which syrup is delivered from the beverage boxes 34, and in which carbonated water is delivered from the carbonator 30 to the machine 32 is standard, and therefore is not discussed in any detail here.

As noted above, the gas from the storage tank 10 is supplied to a normally closed valve 16. In order for the valve 16 to be opened to deliver carbon dioxide gas to the carbonator 30, a relay 18 must be operated. The relay 18 is electrically operated; and whenever electrical power to the relay 18 is interrupted, the normally closed valve 16 closes to prevent flow of carbon dioxide gas through the system to the carbonator 30. This is the "fail safe" mode of operation of the system.

Whenever the pressure sensed by the pressure sensor in the safety pressure monitor system 14 is above a pre-established level (typically, in the normal pressure range of 90 PSI or more), a signal is supplied to close a normally open switch 22. This is indicated by the dotted line 36 in the drawing. This signal and the particular type of switch, and the manner in which the switch is closed, may be of any suitable type. The switch 22 is indicated in the drawing diagrammatically as a single-pole-single-throw mechanical switch of the type which may be operated by a relay. The switch 22, however, may be a micro switch, or a transistor, electronic switch, or any other suitable type of switch. The particular type of switch is not important to the invention; so it has been depicted functionally as a shown in the drawing.

When the switch 22 is closed by way of the link shown as the dotted line 36 in the drawing, power is applied from a suitable source of alternating current power 20, through a rectifier 24, to operate the relay 18. When the relay 18 is operated, the valve 16 is opened, and allows gas to pass through the valve to the carbonator 30 causing the system to operate in its normal mode of operation.

So long as there are no leaks or an unintentionally left open demand for $CO_2$ gas from the beverage dispensing unit 32, the system operates as if the safety tank pressure monitor system 14 was not present. In the event, however, that a sudden and/or prolonged drop in pressure as a result of a leak or other abnormal flow of gas out of the tank 10 takes place, the low pressure condition is sensed by the monitor 14; and the switch 22 is opened. When the switch 22 is opened, no further power is delivered to the relay 18; and therefore, the normally closed valve 16 again closes. This terminates the delivery of $CO_2$ gas to the carbonator 30, so long as this low pressure condition exists.

With the valve 16 closed, however, the system stabilizes; and pressure is allowed to build up naturally from the tank 10. The stabilization of the system at a preselected upper pressure automatically occurs as a result of the nature of the liquid $CO_2$ in the tank. When the desired operating-pressure is sensed by the unit 14, the switch 22 is closed; and the valve 16 is opened to again permit flow of $CO_2$ gas to the carbonator 30. If the condition which caused the low pressure sensing from the monitor 14 again takes place, however, as a result of a leak or other uncorrected continuous dispensation of the $CO_2$ gas, the low pressure condition once again will be established. The monitor 14 again senses the low pressure and causes the valve 16 to be closed.

Even though the system may cycle back and forth between a closed valve 16 and an open valve 16, freezing up or icing up of the system is prevented. Obviously, cycling back and forth between the open and closed operation of the valve 16 does not stop leakage, if the condition was caused by leakage. Consequently, repair of whatever caused the leakage still needs to be undertaken. The safety monitor system, however, does provide for operation of the beverage dispenser 32 until such repairs can be made. The operation of the dispenser 32 obviously will be interrupted whenever the valve 16 is closed; so that the persons responsible for the system's operation are provided with a ready indication of some type of malfunction. The malfunction, however, will not result in a frozen condition of the $CO_2$ in the tank 10; and by the nature of the operation of the monitor 14, it is possible to schedule a repair and inspection of the system at a more convenient time, rather than under some type of "emergency" situation.

The foregoing description of an embodiment of the invention is to be considered as illustrative and not limiting. Various changes and modifications will occur to those skilled in the art for performing substantially the same function, in substantially the same way, to achieve substantially the same result, without departing from the true scope of the invention as defined in the appended claims.

What is claimed is:

1. A bulk tank cryogenic safety system including in combination:

a bulk tank source of pressurized gas;

a gas consumption device;

a control valve;

a carbonator;

a gas supply line connected from the bulk tank source of pressurized gas through the control valve to the consumption device; and a pressure monitor system connected to monitor the pressure in the gas supply line between the source of pressurized gas and the carbonator and further connected to the control valve to close the valve when the monitored pressure drops below a first predetermined threshold, thereby interrupting the flow of gas from the source of pressurized gas, and to open the control valve when the monitored pressure rises to a second predetermined threshold greater than the first predetermined threshold, thereby restoring the flow of gas from the source of pressurized gas.

2. A safety system according to claim 1 wherein the control valve is a normally closed valve and the pressure monitor system operates to maintain the control valve open at pressures in the gas supply line above the first predetermined threshold.

3. A safety system according to claim 2 wherein the bulk tank source of pressurized gas is a source of liquid carbon dioxide ($CO_2$).

4. A safety system according to claim 3 wherein the consumption device is a beverage dispensing system.

5. A safety system according to claim 1 wherein the bulk tank source of pressurized gas is a source of liquid carbon dioxide ($CO_2$).

6. A safety system according to claim 5 wherein the consumption device is a beverage dispensing system or a beer dispensing system.

7. A safety system according to claim 1 wherein the consumption device is a beverage dispensing system or a beer dispensing system.

8. A safety system according to claim 1 wherein the control valve is an electrically controlled valve and the pressure monitor system produces an electrical control signal to operate the control valve.

9. A safety system according to claim 8 wherein the control valve is a normally closed valve and the pressure monitor system operates to maintain the control valve open at pressures in the gas supply line above the first predetermined threshold.

10. A safety system according to claim 9 wherein the bulk tank source of pressurized gas is a source of liquid carbon dioxide ($CO_2$).

11. A bulk tank cryogenic safety system and method including:

supplying pressurized carbon dioxide ($CO_2$) from a bulk tank to a consumption device;

monitoring the pressure of gas supplied from the bulk tank to a carbonator;

preventing the supplying of gas from the bulk tank to the consumption device whenever the monitored pressure falls below a predetermined threshold and re-supplying gas from the bulk tank to the consumption device whenever the monitored pressure rises above a second predetermined threshold greater than the first predetermined threshold; and automatically repeating the preventing of supplying gas from the bulk tank and re-supplying the gas as the pressures vary between the first and second predetermined thresholds.

12. The method according to claim 11 wherein the consumption device is a beverage dispensing system.

13. A method according to claim 11 wherein monitoring the pressure of gas supplied from the bulk tank is effected in a gas supply line near the connection of the gas supply line to the bulk tank.

14. An apparatus comprising:

a single tank of pressurized gas, the single tank of pressurized gas providing a flow of pressurized gas;

a carbonator;

a gas supply line connected between the single tank of pressurized gas and the carbonator;

a control valve connected to the gas supply line and controlling the flow of pressurized gas;

a pressure monitoring system being connected to the gas supply line, the pressure monitoring system monitoring a pressure in the gas supply line, the pressure monitoring system being connected to the control valve, the pressure monitoring system closing the control valve to interrupt the flow of pressurized gas from the single tank of pressurized gas when the monitored pressure drops below a first predetermined threshold, and the pressure monitoring system opening the control valve when the monitored pressure rises to a second predetermined threshold greater than the first predetermined threshold, thereby restoring the flow of pressurized gas from the single tank of pressurized gas.

15. The apparatus of claim 14 wherein the single tank of pressurized gas is a tank containing liquid carbon dioxide ($CO_2$).

16. The apparatus of claim 14 further comprising a beverage dispensing system coupled to the carbonator.

17. The apparatus of claim 14 further comprising a water source coupled to the carbonator.

18. The apparatus of claim 14 further comprising:

a beverage dispensing system coupled to the carbonator;

a water source coupled to the carbonator; and at least one of a beverage box or a beverage box cluster coupled to the beverage dispensing system.

19. The apparatus of claim 14 further comprising an electrical circuit coupled to the control valve and the pressure monitoring system, the electrical circuit comprising:

a switch;

an alternating current power source;

a rectifier; and a relay.

20. The apparatus of claim 14 further comprising:

a beverage dispensing system coupled to the carbonator;

a water source coupled to the carbonator;

at least one of a beverage box or a beverage box cluster coupled to the beverage dispensing system; and an electrical circuit coupled to the control valve and the pressure monitoring system, the electrical circuit comprising:

a switch;

an alternating current power source;

a rectifier; and a relay.

* * * * *